US005109679A

United States Patent [19]

Hida

[11] Patent Number: 5,109,679

[45] Date of Patent: May 5, 1992

[54] AUGER TYPE ICE MAKING MACHINE

[75] Inventor: Junichi Hida, Nagoya, Japan

[73] Assignee: Hoshizaki Denki Kabushiki Kaisha, Aichi, Japan

[21] Appl. No.: 706,926

[22] Filed: May 31, 1991

[30] Foreign Application Priority Data

Jun. 1, 1990 [JP] Japan ..... 2-58494

[51] Int. Cl.[5] ..... F25C 5/12

[52] U.S. Cl. ..... 62/320; 62/354; 241/DIG. 17

[58] Field of Search ..... 62/320, 354; 241/DIG. 17, 82.5, 186 R, 186 A

[56] References Cited

U.S. PATENT DOCUMENTS

| | | | |
|---|---|---|---|
| 3,037,714 | 6/1962 | Bayston | 241/DIG. 17 |
| 3,230,737 | 1/1966 | Lunde | 62/354 |
| 3,662,564 | 5/1972 | Clearman et al. | 62/320 |
| 4,198,831 | 4/1980 | Barnard et al. | 62/320 |
| 4,484,455 | 11/1984 | Hida | 62/354 X |
| 4,682,475 | 7/1987 | Nelson | 62/354 |
| 4,969,337 | 11/1990 | Hida | 62/354 X |

*Primary Examiner*—William E. Tapolcai
*Attorney, Agent, or Firm*—Nikaido, Marmelstein, Murray & Oram

[57] ABSTRACT

In an auger type ice making machine, an ice breaker mounted on an upper shaft portion of the auger includes a plurality of ice breaker elements adapted to be coaxially coupled as a unit, the breaker elements each having a circular body portion formed with a plurality of circumferentially equally spaced blades which extend radially outwardly at a predetermined angle, and the blades of the respective breaker elements being formed to be aligned at their lower edges in a condition where the breaker elements have been coaxially coupled at their body portions. The body portions of the breaker elements are connected to each other in such a manner that the blades of the breaker elements are circumferentially equally spaced at a selected angle.

2 Claims, 3 Drawing Sheets

AUGER TYPE ICE MAKING MACHINE

BACKGROUND OF THE INVENTION

1. Field of the Invention

The present invention relates to an auger type ice making machine, and more particularly to an improvement of an ice breaker for breaking the rods of ice emerging from extruding passages of an extrusion head.

2. Description of the Prior Art

In a conventional auger type ice making machine, an ice breaker mounted on the top of the rotating auger has a plurality of breaker blades for breaking off the rods of ice emerging from extruding passages of the extrusion head into pieces of relatively hard flake ice. Since the pitch of the breaker blades in a circumferential direction is constant in general, replacement of the ice breaker is required for change of the size and quality of the flake ice pieces.

In Japanese Utility Model Early Publication No. 62-17768, there has been proposed an improved ice breaker which can be selectively positioned at the top of the auger in a circumferential direction for change of its rotary pitch. With such an ice breaker, the size and quality of the flake ice pieces can be changed without replacement of the ice breaker. Although the ice breaker is useful in an auger type ice making machine the auger of which is formed with a single helical blade to succesively extrude a rod of ice through a portion of the extruding passages of the extrusion head, the size and quality of flake ice pieces may not be adjusted in an auger type ice making machine the auger of which is formed with two or more helical blades to simultaneously extrude plural rods of ice through the extruding passages of the extrusion head. If the rods of ice emerging from the extrusion head were broken by the breaker blade in a different rotary pitch, the flake ice pieces would be combined in different sizes and quality.

SUMMARY OF THE INVENTION

It is, therefore, a primary object of the present invention to provide an improved ice breaker which is useful for change of the flake ice pieces in size and quality in an auger type ice making machine the auger of which is formed with two or more helical blades to simultaneously extrude plural rods of ice from the extrusion head.

According to the present invention, the primary object is attained by providing an ice breaker which comprises a plurality of ice breaker elements adapted to be coaxially coupled as a unit, the breaker elements each having a circular body portion formed with a plurality of circumferentially equally spaced blades which extend radially outwardly at a predetermined angle, the blades of the respective breaker elements being formed to be aligned at their lower edges in a condition where the breaker elements have been coaxially coupled at their body portions, and means for connecting the body portions of the breaker elements to each other in such a manner that the blades of the breaker elements are circumferentially equally spaced at a selected angle.

BRIEF DESCRIPTION OF THE DRAWINGS

Other objects, features and advantages of the present invention will be more readily appreciated from the following detailed description of preferred embodiments thereof when taken together with the accompanying drawings, in which.

DESCRIPTION OF THE PREFERRED EMBODIMENTS

Figure 1:
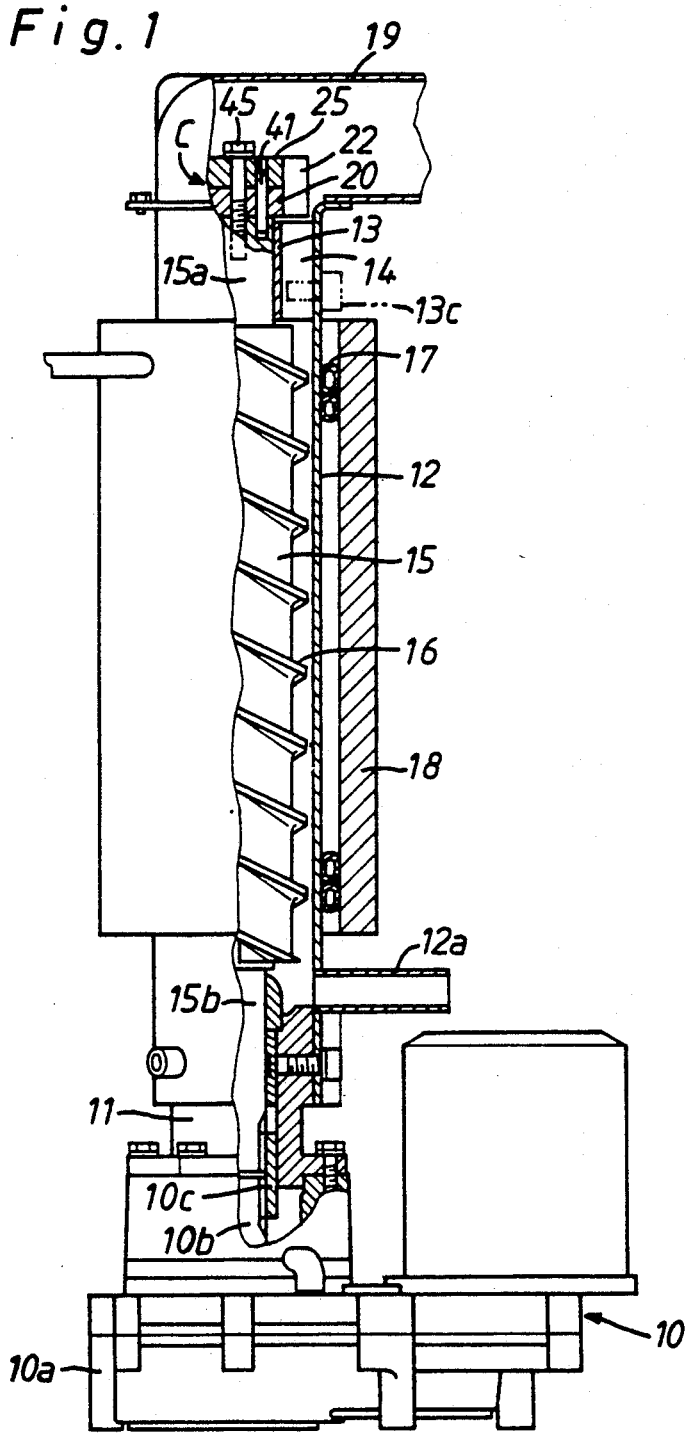
FIG. 1 is a fragmentary sectional view of an auger type ice making machine provided with an improved ice breaker in accordance with the present invention.

In FIG. 1 of the drawings, there is illustrated an auger type ice making machine which includes a cylindrical evaporator housing 12 vertically mounted on a gear casing 10*a* of a geared motor 10 through a cylindrical support member 11. An auger 15 is coaxially disposed within the evaporator housing 12 and rotatably carried by the cylindrical support member 11 through a radial bearing sleeve at its lower shaft portion 15*b*. An extrusion head 13 is coupled within the upper end portion of evaporator housing 12 and secured in place by fastening screws 13*c* to rotatably support an upper shaft portion 15*a* of auger 15. The low shaft portion 15*b* of auger 15 is drivingly connected to an output shaft 10*b* of geared motor 10 by means of a spline coupling 10*c*. The auger 15 has two helical blades 16 integrally formed thereon. The evaporator housing 12 is surrounded by a freezing coil 17 through which refrigerant is passed in an usual manner to chill the housing 12. The freezing coil 17 is covered with heat-insulation material 18. A water supply pipe 12*a* is connected to a lower portion of evaporator housing 12 to supply fresh water to the internal cylindrical freezing surface of housing 12 from any suitable source of water.

Figure 2:
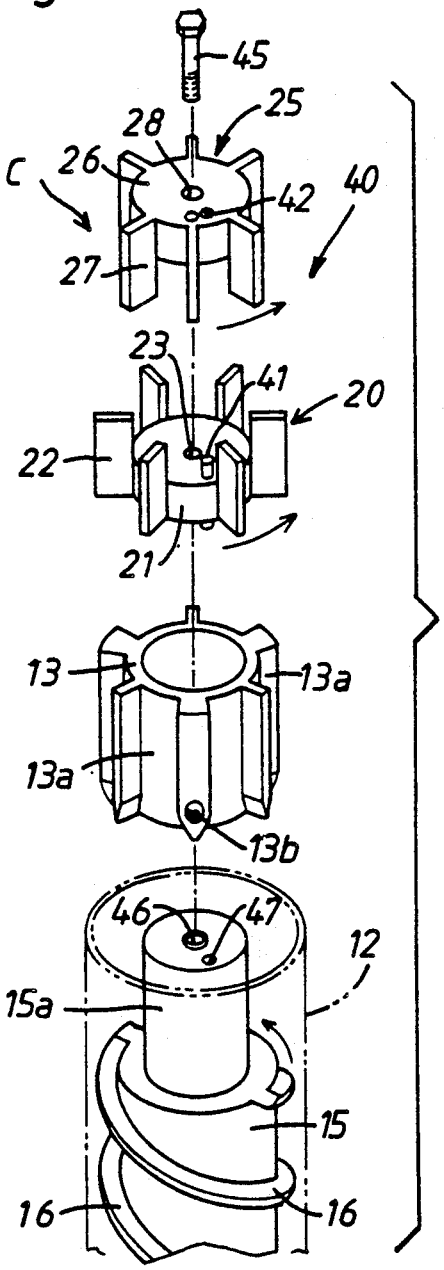
FIG. 2 is a perspective view showing disassembled parts of the ice breaker in relation to an extrusion head and an auger shown in FIG. 1.

As shown in FIG. 2, the extrusion head 13 has a cylindrical body portion which is formed therein with an axial bore for support of the upper shaft portion 15*a* of auger 15. The cylindrical body portion of auger 13 is formed thereon with three circumferentially equally spaced thick fins which are formed therein with threaded holes 13*b* for engagement with the fastening screws 13*c*. Three circumferentially equally spaced thin fins are further formed on the cylindrical body portion of auger 13 between adjacent pairs of the thick fins to form six extruding passages 13*a*. As shown in FIG. 1, an ice breaker C of the present invention is coaxially mounted on the upper end of auger 15 by means of fastening bolt 45 for rotation therewith and is housed in an ice discharge duct 19 which is fixedly mounted on the upper end of evaporator housing 12.

Figure 3A:
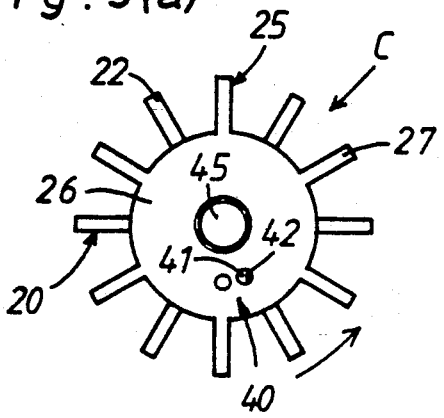
FIGS. 3(*a*) and 3(*b*) each are a plan view of the ice breaker respectively in first and second assembled conditions.
Figure 3B:
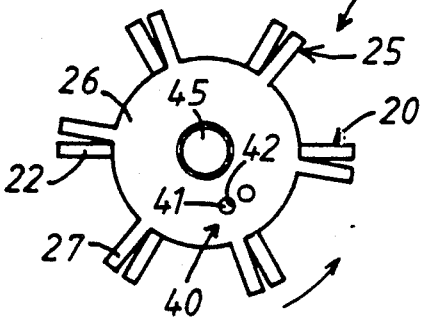

As shown in FIGS. 2 and 3, the ice breaker C includes lower and upper breaker elements 20 and 25 which are coaxially assembled and connected to each other as a unit by means of connecting means 40. The lower breaker element 20 has a circular body portion 21 integrally formed with six circumferentially equally spaced rectangular blades 22 which extend radially outwardly at an angle of sixty degrees. Similarly, the upper breaker element 25 has a circular body portion 26 integrally formed with six circumferentially equally spaced rectangular blades 27 which extend radially outwardly at an angle of sixty degrees. The circular body portions 21 and 26 are the same in diameter and thickness and formed with central holes 23, 28 for passing therethrough the fastening bolt 45. The blades 22 of lower breaker element 20 are formed to extend upwardly along the outer circumference of body portion 26 of upper breaker element 25 with a slight clearance, while the blades 27 of upper breaker element 25 are formed to extend downwardly along the outer circumference of body portion 21 of lower breaker element 20 with a slight clearance. The full length of breaker blades 22, 27 is determined to be equal to the thickness of both the circular body portions 21 and 26. Accordingly, the upper and lower edges of breaker blades 22 are aligned at the same height as those of breaker blades 27 when the body portions 21 and 26 have been coaxially coupled.

The connecting means 40 includes a connecting pin 41 eccentrically fixed to the body portion 21 of lower breaker element 20 in parallel with its central axis and projected upwardly and downwardly from the body portion 21. The body portion 26 of upper breaker element 25 is formed therein with two circumferentially spaced vertical holes 42 for engagement with the connection pin 41. In a first condition where the connecting pin 41 has been engaged with the right-hand vertical hole 42 in the body portion 26 of upper breaker element 25 as shown in FIG. 3(*a*), the upper breaker element 25 is overlapped with the lower breaker element 20 in such a manner that the breaker blades 22 and 27 are circumferentially equally spaced at a small angle of less than thirty degrees. In a second condition where the connecting pin 41 has been engaged with the left-hand vertical hole 42 in the body portion 26 of úpper breaker element 25 as shown in FIG. 3(*b*), the upper breaker element 25 is overlapped with the lower breaker element 20 in such a manner that the upper breaker blades 27 are maintained in engagement with the adjacent lower breaker blades 22 to be circumferentially equally spaced from the remote lower breaker blades 22 at a large angle of less than sixty degrees. Thus, the angular space between the breaker blades 22 and 27 in the second condition becomes twice the angular space in the first condition. The ice breaker C assembled as shown in FIG. 3(*a*) or 3(*b*) is mounted on the upper end of upper shaft portion 15*a* of auger 15 and fixed in place by means of the fastening bolt 45 as shown in FIG. 1. In this instance, the lower end of connecting pin 41 is engaged with a vertical hole 47 in the upper end of shaft portion 15*a* of auger 15 to restrict rotation of the ice breaker C relative to the auger 15.

In operation of the ice making machine, the fresh water supplied from pipe 12*a* into the evaporator housing 12 is frozen by heat-exchange with the freezing coil 17 to cause ice crystals to form on the internal surface of evaporator housing 12. When the auger 15 is driven by the geared motor 10 to rotate in the evaporator housing 12, the auger blades 16 scrape the ice crystals off the internal freezing surface of evaporator housing 12 and advance the ice upwardly toward the extrusion head 13. Thus, the ice is forced upwardly into the extruding passages 14 of head 13 and compressed to be successively extruded from the extruding passages 14 upwardly as a rod of ice in accordance with the rotation speed of auger 15. The extruded rod of ice is broken by the lower edges of the breaker blades 22 and 27 into pieces of relatively hard flake ice to be delivered into the discharge chut 19. In the first condition where the ice breaker C has been coaxially assembled as shown in FIG. 3(*a*), the rod of ice is broken by the breaker blades 22 and 27 at a short time interval since the angular space between the breaker blades 22 and 27 is determined to be small. As a result, the pieces of relatively hard flake ice become small in size. In the second condition where the ice breaker C has been coaxially assembled as shown in FIG. 3(*b*), the rod of ice is broken by the breaker blades 22 and 27 at a long time interval since the angular space between the breaker blades 22 and 27 is determined to be large. As a result, the pieces of relatively hard flake ice become large in size.

From the above description, it will be understood that two kinds of relatively hard flake ice different in size can be obtained by change of the angular space between the breaker blades 22 and 27. When the ice breaker C has been assembled in the first or second condition as shown in FIGS. 3(*a*) or 3(*b*), all the angular spaces between the breaker blades 22 and 27 are uniformly determined in the same angular space. As a result, all the rods of ice emerging from the extrusion head 13 are broken into pieces of relatively hard flake ice in the same size.

Figure 4:
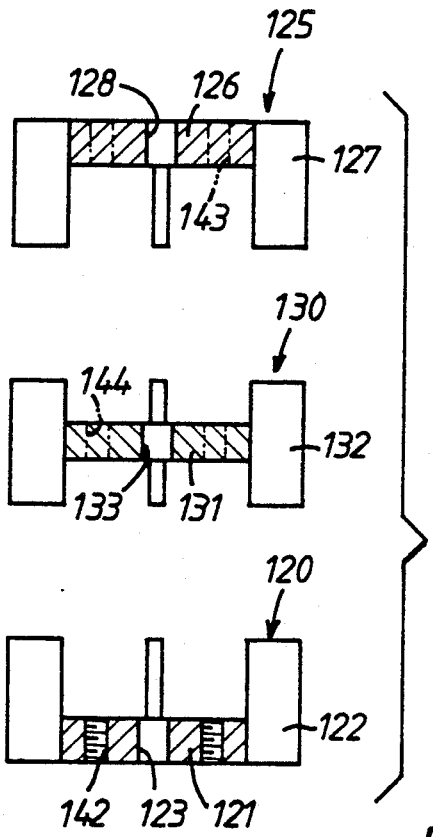
FIG. 4 is a sectional view showing disassembled parts of a modification of the ice breaker.

Although in the foregoing embodiment the ice breaker C has been composed of the lower and upper breaker elements 20 and 25, it may be composed of lower, upper and intermediate breaker elements 122, 125 and 130 as shown in FIG. 4. In such a modification, the lower breaker element 122 has a circular body portion 121 integrally formed with four rectangular blades 122 circumferentially equally spaced at an angle of ninety degrees, and the upper breaker element 125 has a circular body portion 126 integrally formed with four rectangular blades 127 circumferentially equally spaced at an angle of ninety degrees. Similarly, the intermediate breaker element 130 has a circular body portion 131 integrally formed with four rectangular blades 132 circumferentially equally spaced at an angle of ninety degrees. The blades 122 of lower breake element 120 are formed to extend upwardly along the outer circumference of body portions 131 and 126 of intermediate and upper breaker elements 130 and 125 with a slight clearance, while the blades 127 of upper breaker element 127 are formed to extend downwardly along the outer circumference of body portions 131 and 121 of intermediate and lower breaker elements 130 and 122 with a slight clearance. The blades 132 of intermediate breaker element 130 are formed to extend upwardly along the outer circumference of body portion 126 of upper breaker element 125 and to extend downwardly along the outer circumference of body portion 121 of lower breake element 120. The circular body portions 121, 131 and 126 are the same in diameter and thickness and formed with central holes 123, 133 and 128 for passing therethrough the fastening bolt 45. The full length of breake blades 122, 132, 127 is determined to be equal to the thickness of all the circular body portions 121, 131 and 126. Accordingly, the upper and lower edges of breaker blades 122, 132, 127 are aligned at the same height when the body portions 121, 131 and 126 have been coaxially coupled to one another.

In this modification, the body portion 121 of lower breaker element 120 is formed with a pair of diametrically opposed vertical holes 142 for engagement with a pair of fastening screws 141. The body portion 131 of intermediate breaker element 130 is formed with two pairs of diametrically opposed vertical holes 144 which are positioned to selectively correspond with the vertical holes 142 of body portion 121. The body portion 126 of upper breaker element 125 is formed with three pairs of diametrically opposed vertical holes 143 which are positioned to selectively correspond with the vertical holes 142 of body portion 121. In a first condition where the fastening screws 141 have been threaded into the vertical holes 142 of lower body portion 121 through the vertical holes 143 and 144 of upper and intermediate body portions 126 and 131 as shown in FIG. 5(*a*), the breaker elements 120, 130 and 125 are coaxially assembled as a unit in such a manner that the breaker blades 122, 132, 127 are circumferentially equally spaced at a small angle of less than thirty degrees.

Figure 5A:
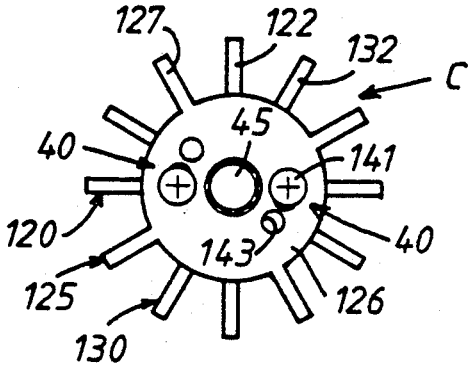
FIGS. 5(*a*), 5(*b*) and 5(*c*) each are a plan view of the modified ice breaker respectively in first, second and third assembled conditions.
Figure 5B:
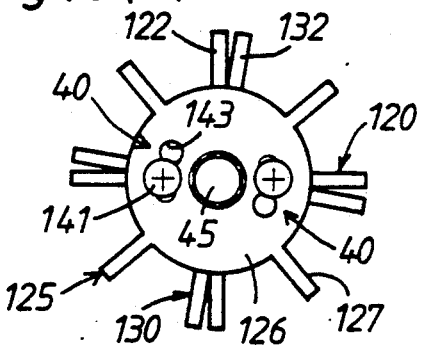
Figure 5C:
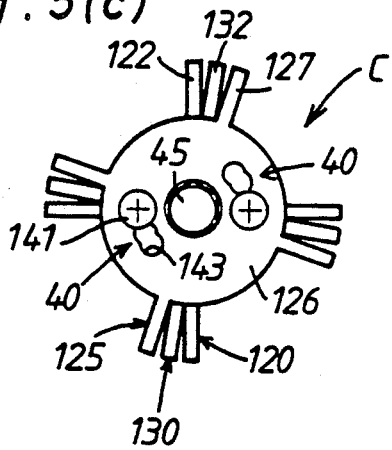

In a second condition where the fastening screws 141 have been threaded into the vertical holes 142 of lower body portion 121 through the vertical holes 143 and 144 of upper and intermediate body portions 126 and 131 as shown in FIG. 5(*b*), the breaker elements 120, 130 and 125 are coaxially assembled as a unit in such a manner that the breaker blades 122 and 132 are maintained in engagement to one another to be circumferentially equally spaced from the breaker blades 127 of upper body portion 125 at a large angle of less than fourty five degrees. In a third condition where the fastening screws 141 have been threaded into the vertical holes 142 of lower body portion 121 through the vertical holes 143 and 144 of upper and intermediate body portions 126 and 131 as shown in FIG. 5(*c*), the breaker elements 120, 130 and 125 are coaxially assembled as a unit in such a manner that the breaker blades 122, 132 and 127 are maintained in engagement to one another to be circumferentially equally spaced from the remote breaker blades at a large angle of less than ninety degrees. Thus, the angular space between the breaker blades 122, 132 and 127 can be changed to be minimum in the first condition shown in FIG. 5(*a*) and maximum in the third condition shown in FIG. 5(*c*) and to be intermediate in the second condition shown in FIG. 5(*b*). The ice breaker C assembed as shown in FIG. 5(*a*), 5(*b*) or 5(*c*) is mounted on the upper end of upper shaft portion 15*a* of auger 15 and fixed in place by means of the fastening bolt 45 threaded into the hole 46 in the upper end of auger 15 through the central holes 128, 133 and 123 of body portions 126, 131 and 121. In this instance, rotation of the ice breaker relative to the auger 15 is restricted in the same manner in the foregoing embodiment.

Although in the foregoing embodiments the breaker blades are vertically formed on the body portions of the respective breaker elements, the breaker blades may be inclined backwardly at an appropriate angle with respect to the body portions of the respective breaker elements.

Having now fully set forth both structure and operation of preferred embodiments of the concept underlying the present invention, various other embodiments as well as certain modifications of the embodiments herein shown and described will obviously occur to those skilled in the art upon becoming familiar with said underlying concept. It is to be understood, therefore, that within the scope of the appended claims, the invention may be practiced otherwise than as specifically set forth herein.

What is claimed is:

1. An auger type ice making machine including an evaporator housing having an internal cylindrical freezing surface on which ice crystals are formed, an auger rotatably mounted within said evaporator housing and being formed with a helical blade for scraping the ice crystals off said internal freezing surface and advancing the ice crystals toward an upper end of said evaporator housing, an extrusion head formed with a plurality of ice extruding passages and being positioned in place within the upper end portion of said evaporator housing to rotatably support an upper shaft portion of said auger, and an ice breaker mounted on the upper shaft portion of said auger for rotation therewith and being positioned above said extrusion head for breaking the rods of ice extruded upwardly from said ice extruding passages into pieces of relatively hard flake ice.

wherein said ice breaker comprises a plurality of ice breaker elements adapted to be coaxially coupled as a unit, said breaker elements each having a circular body portion formed with a plurality of circumferentially equally spaced blades which extend radially outwardly at a predetermined angle, said blades of said respective breaker elements being formed to be aligned at their lower edges in a condition where said breaker elements have been coaxially coupled at their body portions, and means for connecting said body portions of said breaker elements to each other in such a manner that said blades of said breaker elements are circumferentially equally spaced at a selected angle.

2. An auger type ice making machine as claimed in claim 1, wherein said blades of said respective breaker elements are rectangular.

* * * * *